US006508382B2

(12) United States Patent
Niada

(10) Patent No.: US 6,508,382 B2
(45) Date of Patent: Jan. 21, 2003

(54) ELEMENT FOR ADJUSTING THE OUTLET WIDTH IN PAPER TOWELS DISPENSERS

(75) Inventor: Gianandrea Niada, Milan (IT)

(73) Assignee: QTS S.r.l., Brugherio Milan (IT)

( * ) Notice: Subject to any disclaimer, the term of this patent is extended or adjusted under 35 U.S.C. 154(b) by 114 days.

(21) Appl. No.: 09/804,108

(22) Filed: Mar. 12, 2001

(65) Prior Publication Data

US 2001/0023874 A1 Sep. 27, 2001

(30) Foreign Application Priority Data

Mar. 23, 2000 (IT) ..... MI20A0613

(51) Int. Cl.[7] ..... A47K 10/24
(52) U.S. Cl. ..... 221/45; 221/304
(58) Field of Search ..... 221/33, 45, 46, 221/48, 63, 56, 241, 305, 304, 307; 206/812, 449, 494

(56) References Cited

U.S. PATENT DOCUMENTS 6,349,849 B1 * 2/2002 Pehr ..... 221/33

* cited by examiner

*Primary Examiner*—Kenneth W. Noland
(74) *Attorney, Agent, or Firm*—Akin, Gump, Strauss, Hauer & Feld, L.L.P.

(57) ABSTRACT

An element for adjusting the width of the outlet (11) in paper towel dispensers (10) consists of a single piece molded in a plastic material having resilience features, in two specular left **(1*a*) and right (1*b*) versions, which is substantially C-shaped with two lugs extending from a central body. Said lugs are parallel and spaced by a distance substantially equal to the thickness of the bottom wall (12) of the dispenser (10) in the area where the outlet (11) is formed, so as to enclose said area between a first lug of smaller extension on the outer side and a second lug of greater extension on the inner side. The inner lug carries a securing member suitable to couple with any of a plurality of mating fixing members provided close to the outlet (11) of the dispenser (10)**, so as to reduce by an adjustable extent the free width of the outlet.

5 Claims, 2 Drawing Sheets

ELEMENT FOR ADJUSTING THE OUTLET WIDTH IN PAPER TOWELS DISPENSERS

BACKGROUND OF THE INVENTION

The present invention relates to an element for adjusting the outlet width in dispensers of paper towels, in particular but not necessarily of the type in which the paper towels are mutually interleaved or intercalated (i.e. of the C-shaped type) and stacked in a dispenser with a bottom outlet.

It is known that in dispensers of paper towels of the above-mentioned type, but also of towels cut from a continuous roll, the dispenser outlet has a well definite cross-section corresponding to a certain width of the paper towel to be manually pulled out through the outlet. Clearly you can not be sure to use always the same type of paper, whose size can change in width, e.g. if you change supplier, thus making the operation of the dispenser less than optimal. In fact, if a paper having a width significantly smaller than the dispenser outlet width is used, the removal of single paper sheets at each manual pulling action performed by the user can no longer be guaranteed.

This drawback has been overcome until now by providing templates of different sizes to be applied to the dispenser outlet, so as to change the shape and size of its cross-section, but it is clearly unpractical to have a template for each different size of the paper sheets used in the dispenser.

BRIEF SUMMARY OF THE INVENTION

Therefore the object of the present invention is to provide, for any dispenser, a pair of adjusting elements which can take different positions along the dispenser outlet thus changing the width thereof according to the size of the paper sheets in use.

It should be noted that such adjusting elements can be useful also in dispensers of paper towels cut from a continuous roll, by forming a lateral guide which better follows the sheet during its unwinding and removal from the dispenser, regardless of the way in which this takes place.

This object is achieved through an adjusting element, in the specular right and left versions, having the characteristics cited in claim 1.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
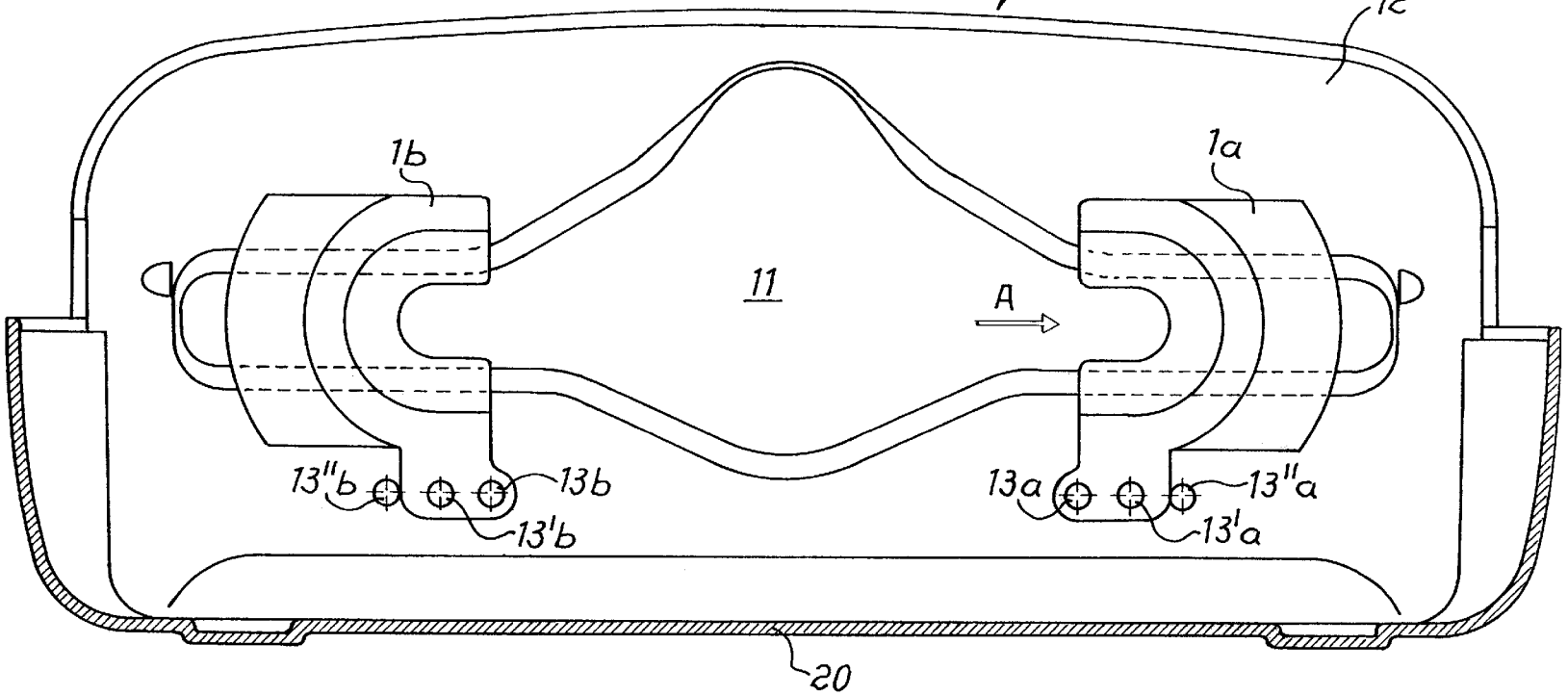
FIG. 1 shows a plan view of a paper towels dispenser outlet from the inside, with two adjusting elements according to the invention mounted at the ends of the outlet.

With reference to FIG. 1, a known dispenser 10, wherein mutually interleaved or intercalated paper towels are stacked, is depicted in a cross-sectional plan view so as to show the properly shaped outlet 11, formed in the bottom wall 12 of the dispenser. Such a dispenser is usually secured to a supporting wall through a mounting plate schematically illustrated as 20. Moreover, outlet 11 is usually shaped so as to define, at the sides of a central area of greater transverse height, two end portions of substantially constant height, with opposite parallel sides which are joined through a curved radius line at each end.

According to the present invention, at each portion of constant height of outlet 11 it is possible to secure an adjusting element, respectively left 1*a* and right 1*b* (as seen by the user standing in front of the dispenser), in a position selected among a plurality of mounting positions, so as to reduce by an adjustable extent the free width of the outlet. To this purpose fixing members are provided, preferably in the bottom wall 12 of the dispenser, or elsewhere but close to outlet 11. In particular, two series of aligned holes 13*a,* 13'*a,* 13"*a* and 13*b,* 13'*b,* 13"*b* are formed in the bottom wall 12 between outlet 11 and plate 20 respectively to the left and to the right with respect to the outlet transverse axis. These holes are suitable to couple with respective mating securing members, e.g. a peg 3*a* on the left adjusting element and a peg 3*b* on the right adjusting element, according to the desired width of the outlet, i.e. according to the size of the paper sheets loaded in the dispenser.

In FIG. 1 the securing pegs 3*a* and 3*b* are depicted as respectively coupled with the holes 13*a* and 13*b* closest to the center of the outlet, so as to achieve the minimum width thereof, and obviously the coupling will be symmetrical with respect to the outlet transverse axis. The number of three possible positions is just an example, since a greater or smaller number of positions in the bottom wall 12 may be provided at which to mount the adjusting elements, yet always along the constant-height end portions of outlet 11.

Figure 3:
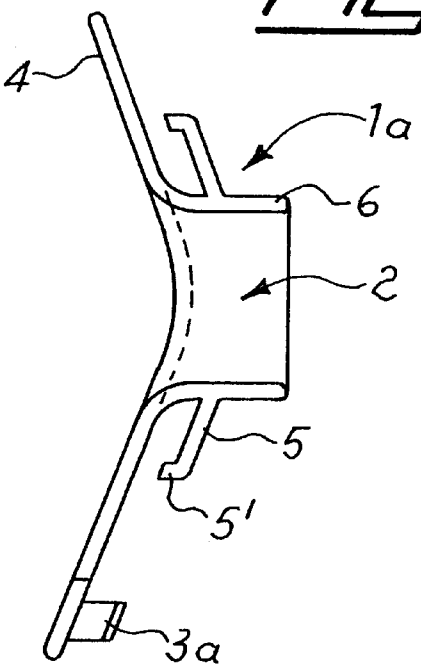
FIG. 3 shows a side view, along the direction of arrow A of FIG. 1, of the left adjusting element according to the present invention, before it is applied to the dispenser outlet.
Figure 2:
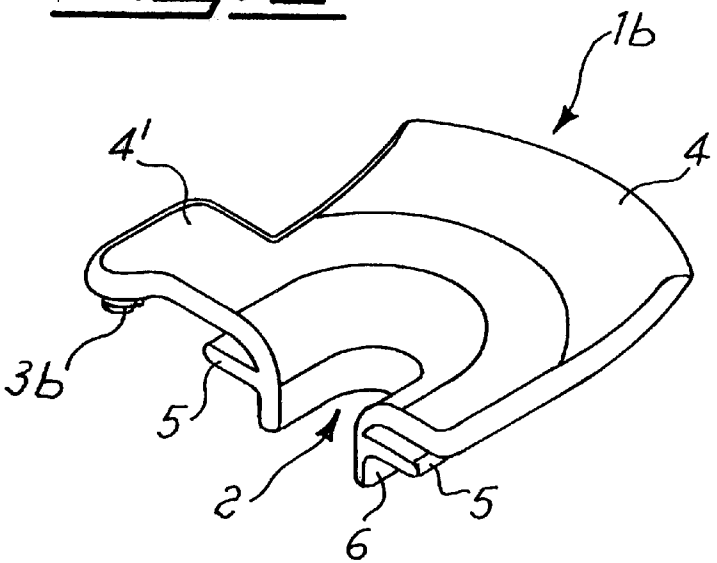
FIG. 2 shows a perspective view of an adjusting element to be mounted on the right of the dispenser.

With particular reference to FIGS. 2 and 3, an adjusting element according to the present invention consists of a single molded piece, preferably of polyethylene, polypropylene, or any moldable plastic material which is not rigid but has a certain degree of resilience.

Broadly speaking, an adjusting element 1*a,* 1*b* is substantially shaped as a C whose aperture 2 is intended to face, when the adjusting element is positioned, the center of the dispenser outlet 11. Around said aperture 2, defined by a central concave body 6 of the adjusting element, there extends a pair of lugs 4 and 5 substantially parallel and spaced by a distance approximately equal to the thickness of the bottom wall 12 of the dispenser in the area of outlet 11.

One of the two lugs, namely the lug referenced by 4 in the drawings, has a greater extension with respect to the second lug 5 and both are shaped with a slight V angle with respect to the central body 6, said angle corresponding to the angle of the bottom wall 12 in the area of outlet 11. In this way, the two lugs 4, 5 perfectly fit over this area enclosing it from inside with lug 4, over a greater extension, and from outside with lug 5, over a smaller extension. The outer lug 5 preferably has a rib 5', projecting towards the inner lug 4, having a height such as to be spaced from the latter by a distance which is not greater than the thickness of the bottom wall 12. This provides for a better gripping of the latter which is enclosed between the two lugs, thanks also to the slight resilience of the material.

Always referring to the drawings, pegs 3*a* and 3*b,* respectively for securing the left adjusting element 1*a* and the right one 1*b,* are shown projecting from an area of the inner lug 4 comparatively far from the central body 6, and on the side facing the outer lug 5. As better shown in FIG. 2, the peg (3*b* in this case) is formed on a lateral extension portion 4' of lug 4. Said securing element could also be double or have a shape different from that of a peg projecting from the inner lug of the adjusting element, as long as it mates with the corresponding fixing members provided in the dispenser, preferably in the bottom wall 12. The number of fixing members obviously determines the number of possibilities of adjusting the position of each adjusting element, and thus the possible sizes of outlet 11 depending on the width of the single interleaved sheets (or continuous roll) which are being used.

It is clear that the above-described and illustrated embodiment of the present element according to the invention is just an example susceptible of various modifications. In particular, the shapes of the two overlying lugs 4, 5 may change as long as they extend from a central body 6 which is substantially C-shaped.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. Element for adjusting the width of the outlet (11) in paper towel dispensers (10), characterized in that it consists of a single piece molded in a plastic material having resilience features, in two specular left (1*a*) and right (1*b*) versions, which is substantially C-shaped with two lugs (4, 5) extending from a central body (6), said lugs (4, 5) being substantially parallel and spaced by a distance substantially equal to the thickness of the bottom wall (12) of the dispenser (10) in the area where the outlet (11) is formed, so as to enclose said area between a first lug of smaller extension (5) on the outer side and a second lug of greater extension (4) on the inner side, the latter carrying at least one securing member (3*a;* 3*b*) suitable to couple with any of a plurality of mating fixing members (13*a,* . . . ; 13*b,* . . . ) provided close to the outlet (11) of the dispenser (10).

2. Adjusting element according to claim 1, characterized in that said securing member (3*a;* 3*b*) consists of a peg projecting from a lateral extension portion (4') of the inner lug (4) on the side facing the outer lug (5), while the mating fixing members (13*a,* . . . ; 13*b,* . . . ) consist of two series of aligned holes formed in the bottom wall (12), respectively to the left and to the right with respect to the outlet transverse axis.

3. Adjusting element according to claim 1, characterized in that said outer lug (5) has a rib (5') projecting towards the inner lug (4), said rib (5') having a height such as to be spaced from the latter by a distance which is not greater than the thickness of the bottom wall (12) in the area where the outlet (11) is formed.

4. Adjusting element according to claim 1, characterized in that the two lugs (4, 5) are shaped with a slight V angle with respect to the central body (6), said angle corresponding to the angle of the bottom wall (12) in the area where the outlet (11) is formed.

5. Adjusting element according to claim 1, characterized in that it is molded in a plastic material selected between polyethylene and polypropylene.

* * * * *